US005975209A

United States Patent [19]

McCorry

[11] Patent Number: 5,975,209

[45] Date of Patent: Nov. 2, 1999

[54] AUTOMATIC BLANKING COMPLETION TOOL

[75] Inventor: Mark McCorry, Aberdeen, United Kingdom

[73] Assignee: Phoenix Petroleum Services Limited, Aberdeenshire, United Kingdom

[21] Appl. No.: 09/118,216

[22] Filed: Jul. 17, 1998

[51] Int. Cl.[6] ..... E21B 43/12

[52] U.S. Cl. ..... 166/321; 166/242.3

[58] Field of Search ..... 166/242.3, 254.2, 166/52, 54.1, 105.4, 321, 332.8

[56] References Cited

U.S. PATENT DOCUMENTS 4,378,847 4/1983 Patel et al. ..... 166/317
5,323,859 6/1994 Smith et al. ..... 166/321

FOREIGN PATENT DOCUMENTS 2288197 11/1995 United Kingdom .

*Primary Examiner*—David Bagnell
*Assistant Examiner*—Chi H. Kang
*Attorney, Agent, or Firm*—Amster, Rothstein & Ebenstein

[57] ABSTRACT

A differential pressure operated blanking tool (1) for use in a completion automatically permits logging operations to be carried out in the absence of fluid flow in the tool (1). The tool (1) includes a pair of limbs (3,5) which communicate via a diverter (7) with a production tubing connection (4). In the absence of fluid flow within the tool (1), the diverter remains open to allow access for logging operations but is movable to a closed position occluding one of the limbs (3) as a result of a pressure differential established by fluid movement in the tool (1).

8 Claims, 5 Drawing Sheets

AUTOMATIC BLANKING COMPLETION TOOL

The present invention relates to a differential pressure-operated blanking completion tool particularly, although not exclusively, for use in by-pass systems of oil and other wells being produced by artificial lift such as an electrical submergible pump (ESP).

The deployment of an ESP in a well is common practice, as is the use of an associated by-pass system whereby access is obtained to the well below the ESP in order that logging operations, for example, may be carried out. Typically, a bypass string depends from one limb of the bifurcated tubing of a completion tool such as a Y-tool and from whose other limb depends the ESP, both limbs communicating with production tubing extending to the surface. The one by-pass limb is sealed during the production of fluid from the well by installing a blanking plug. Such a plug prevents re-circulation of fluid from the pump discharge via the by-pass limb of the completion tool back in to the well. The need to periodically install and remove the plug results in a number of time-consuming and therefore expensive wireline or coiled tubing operations.

In an effort to reduce the number of such operations, a differential pressure operated blanking tool has been proposed which is the subject of a United Kingdom Patent No. 2 288 197B. Such a tool comprises an elongate body arranged to seal within the by-pass tubing or in the throat of a completion tool, and having a passage therethrough to allow deployment into the well of logging tools and gauges, and valve means arranged to close the passage in response to the pressure difference developed by operation of the ESP between pump intake pressure obtaining within the well casing and pump discharge pressure obtaining in the production tubing, and to open the passage on equalisation of the said pressures when operation of the pump is discontinued.

It is, however, an object of the present invention to provide a blanking completion tool which permits access for logging operations below the ESP without the need for any preparatory wireline or coiled tubing operations or separate tools. It is a further object of the invention to provide an automatic blanking completion tool which is robust, simple to operate and install.

According to the present invention there is provided a differential-pressure-operated blanking tool which includes a pair of limbs, the limbs being communicable via a diverter with a production tubing connection, wherein the diverter, in the absence of fluid flow, remains in an open position to allow access for logging operations via said limbs, the diverter being movable to a closed position occluding one of said limbs as a result of a pressure differential established between opposing faces of the diverter due to fluid movement in the tool and thereby preventing said fluid from being recirculated via said limbs.

Preferably, the diverter is held in an open position by biasing means although where, for example, an electrical submergible pump depends from each limb, such means will not be required. Advantageously, the tool may allow pressure testing to be carried out before installation in a completion.

In order to aid in understanding the invention a specific embodiment thereof will now be described by way of example and with reference to the accompanying drawings, in which.

Figure 1:
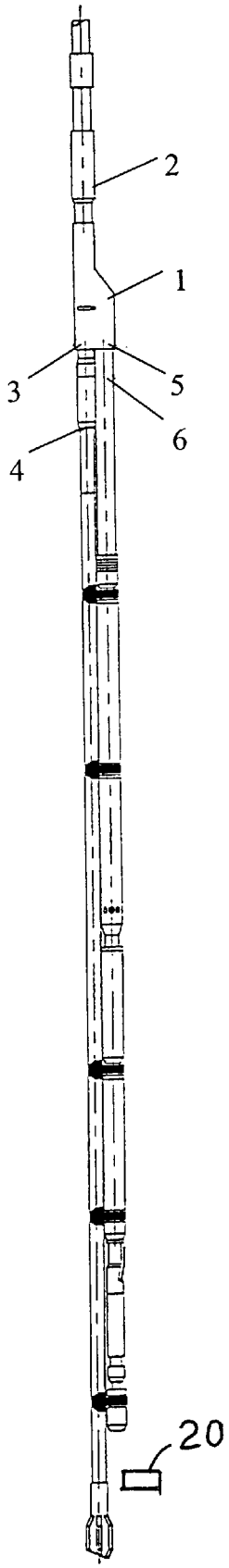
FIG. 1 is a side view of a portion of a completion showing a by-pass system incorporating an automatic blanking completion tool according to the invention.
Figures 6A, 6B, 6C:
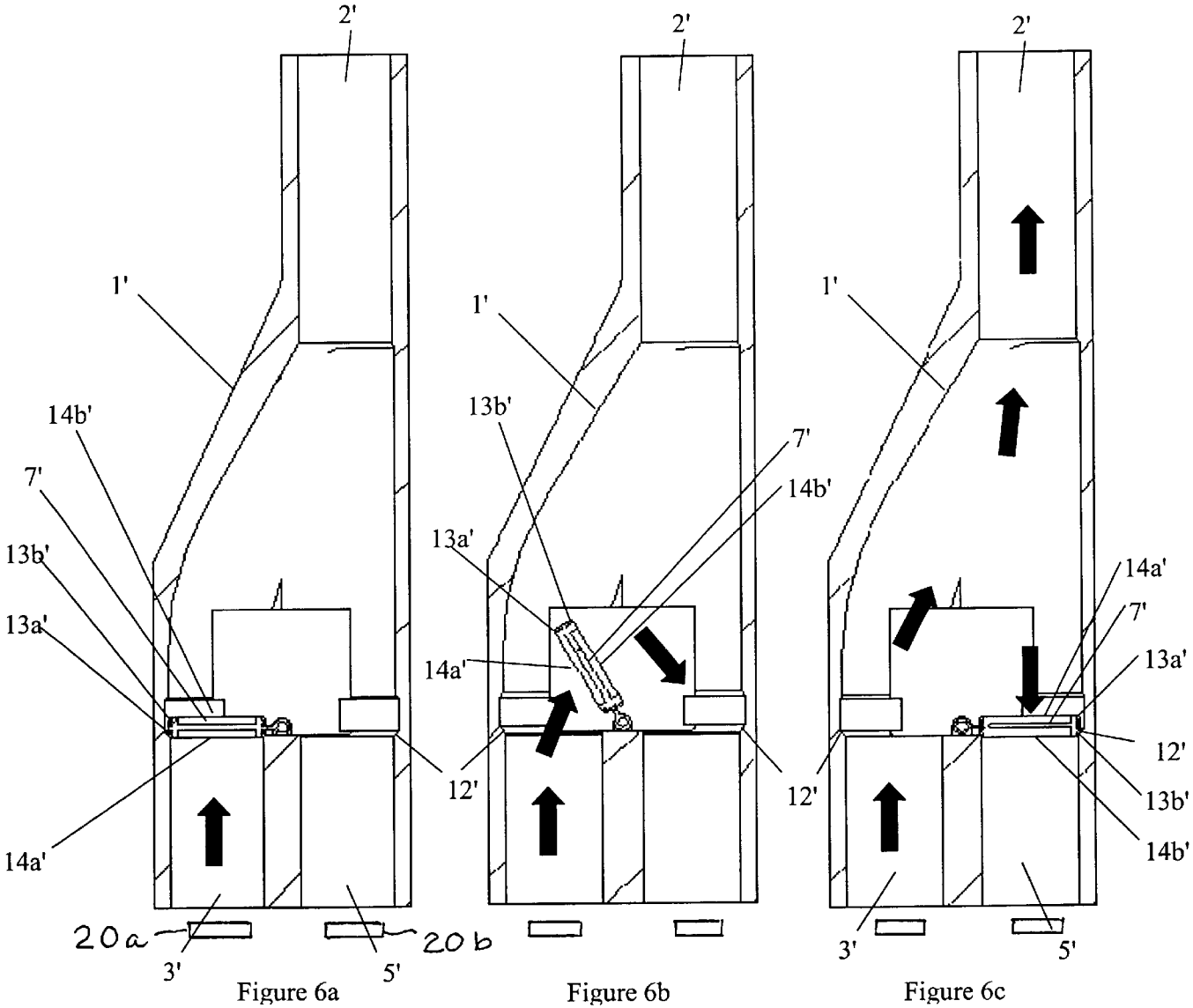
Figures 7A, 7B, 7C:
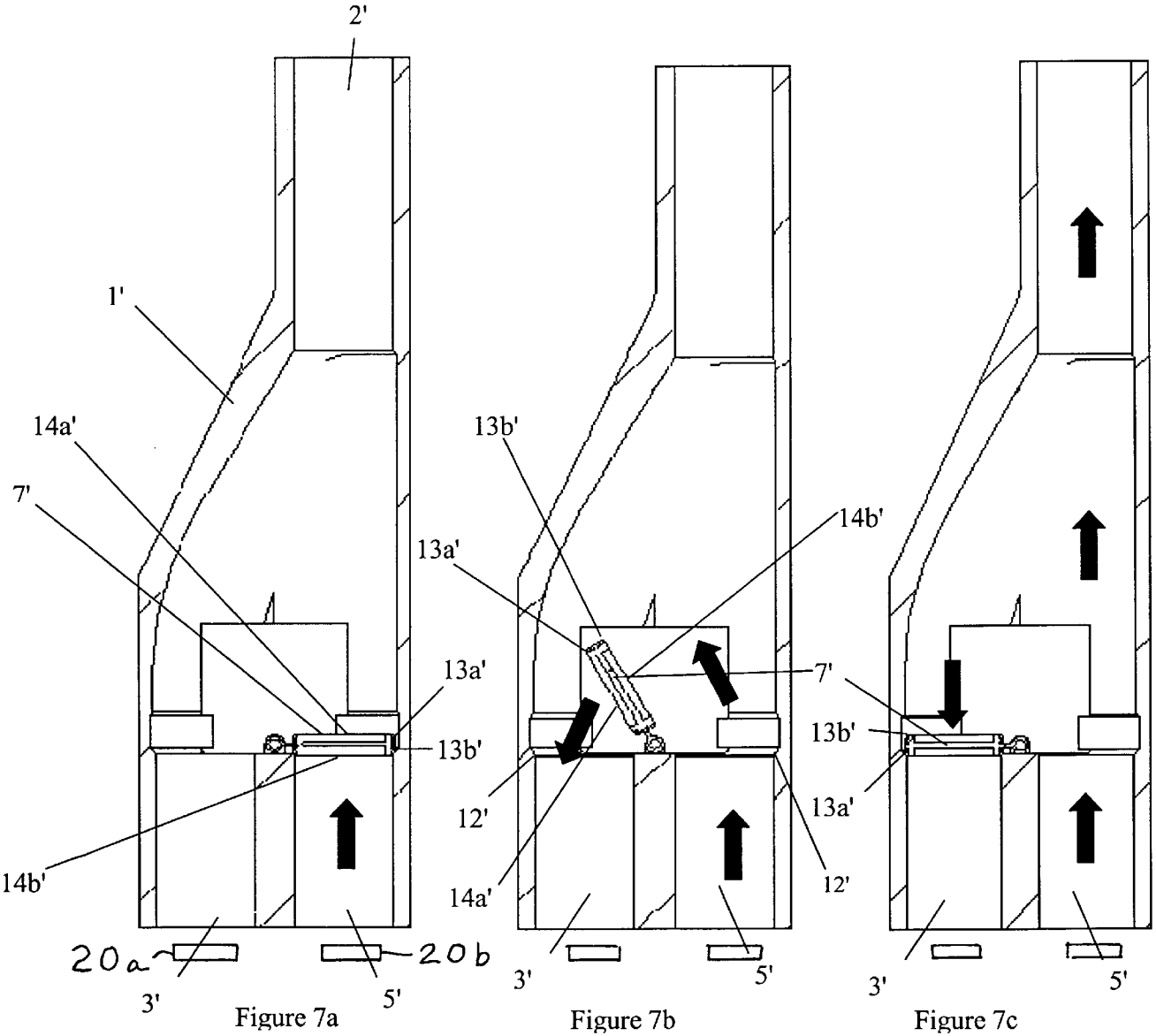

FIGS. 6*a* to 6*c* are a set of longitudinal sectional views of a variant of the tool of FIG. 1 in use with a first electrical submergible pump; and FIGS. 7*a* to 7*c* are similar views of the variant of FIG. 6 in use with a second submergible pump.

Referring to the Figures, an automatic blanking completion tool 1 has a surface tubing connection 2 from which depend two limbs 3,5 of the tool 1. The first or by-pass limb 3 terminates in a by-pass tubing connection 4, whilst the second or ESP limb 5 terminates in a connection 6 to an electrical submergible pump (ESP) 20. A diverter 7 is carried on a shaft 8 journalled between the two limbs 3,5 of the tool 1. A torsion spring 9 carried by the shaft biases the diverter 7 into a normally open position (as shown in FIG. 1).

Figure 5:
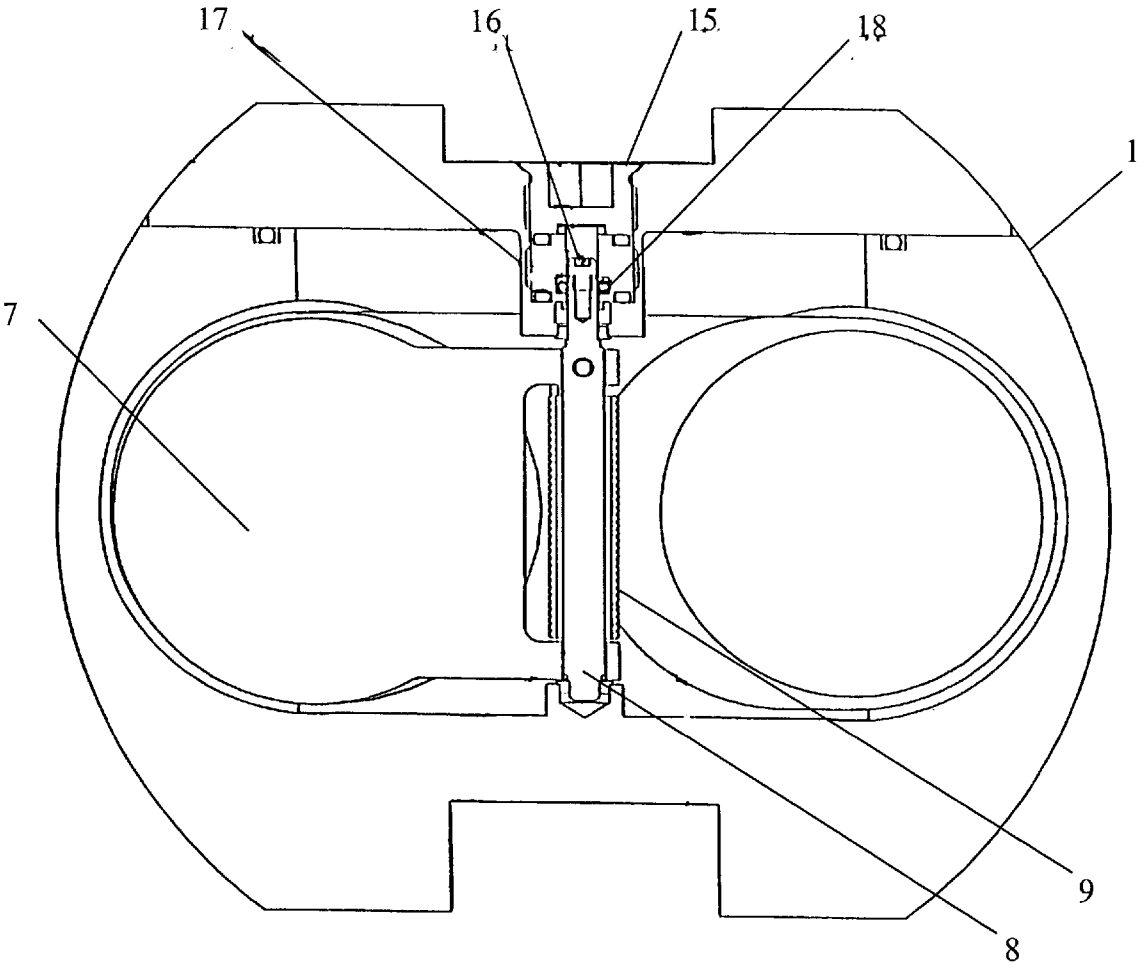
FIG. 5 is a sectional view of the tool on the line V—V of FIG. 3.

An access plate (not shown) provides access to the diverter and associated mechanism for testing and/or overhaul purposes. Thus, whilst the tool is on the surface, the plate may be removed giving access to a cap 15 which is then removed to reveal a drive-head 16 on the shaft 8. By inserting a suitable driver (not shown) onto the head 16, the shaft 8 and thus the diverter 7 may be rotated. In addition, a reversible bush 17 housing O-ring 18 at one end, is carried on the shaft 8. When, as shown in FIG. 5, the bush 17 is orientated with the O-ring 18 forming a seal on the shaft 8, it is possible to carry out pressure testing of the tool 1 at the surface. However, once such procedures are complete, it is then necessary to reverse the bush 17 so that the O-ring 18 is no longer in contact with the shaft 8 to ensure that the rotational losses due to friction are minimised on the shaft 8.

It will be understood from the above that when no flow is occurring through the tool, the diverter 7 remains in its open position and thereby allows access for logging tools to the well via the by-pass limb 3.

Figure 2:
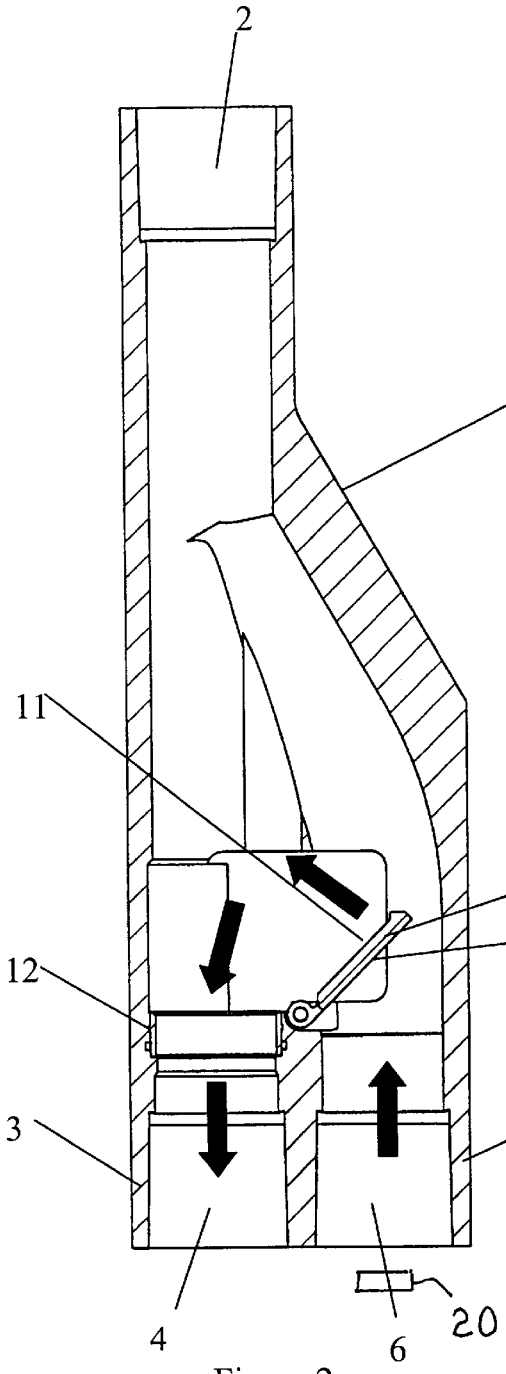
FIG. 2 is a longitudinal section through part of the by-pass system showing in elevation the tool of FIG. 1 invention installed therein with the tool in an open position.
Figure 3:
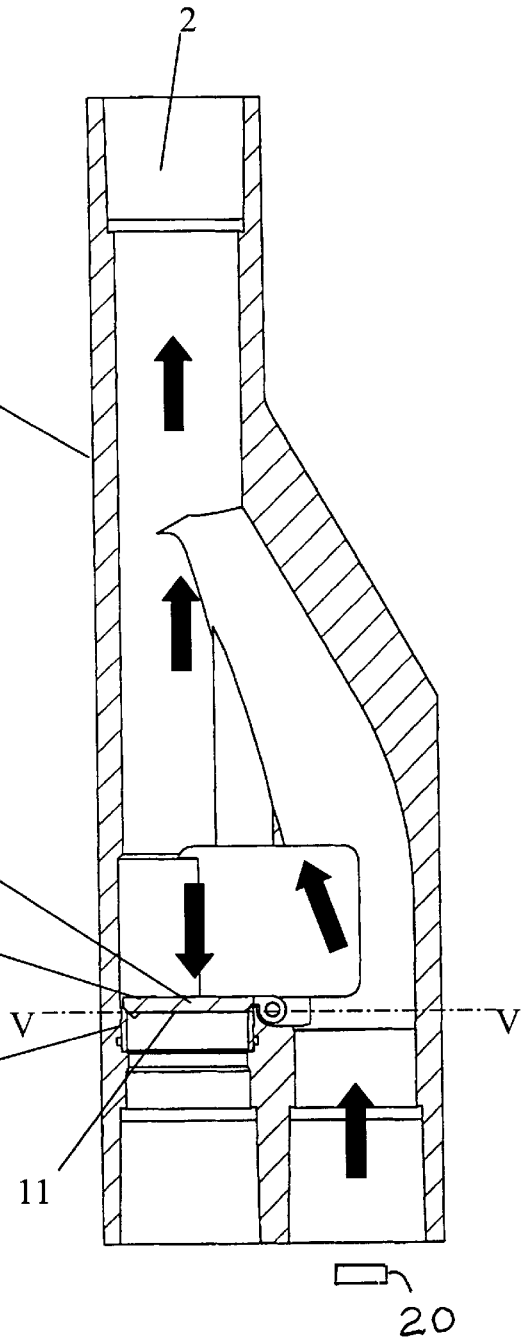
FIG. 3 is a similar view showing the tool in a closed position.
Figure 4:
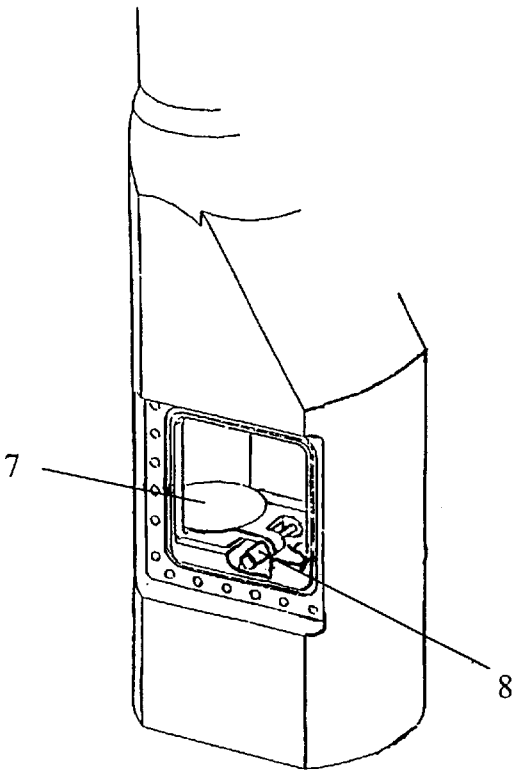
FIG. 4 is a fragmentary isometric view of the tool of FIG. 3 in the closed position with an access plate removed for inspection purposes.

It will be further understood that on operation of the ESP the flow of fluid from the well casing through the pump discharge into the tool will initially adopt the pattern within the tool shown by the arrows on FIG. 2, i.e. fluid is recirculated. However, owing to the pressure differential created by the ESP 20 between the upper and lower opposing surfaces 10,11 of the diverter 7, the diverter 7 will be urged against the biasing force supplied by the torsion spring 9 towards the closed position shown in FIG. 3. Once in the closed position, the lower surface 11 of the diverter 7 will seal against a sealing insert 12 in the by-pass limb 3. The flow within the tool 1 will, once the seal is made, adopt the pattern shown in FIG. 3. Continued operation of the ESP will maintain the pressure differential across the diverter 7 keeping it sealed in the closed position.

To reestablish access for logging tools via the by-pass tubing, it is necessary merely to shut down the ESP thereby equalising the pressure across the opposing faces 10,11 of the diverter 7. The biasing force supplied by the torsion spring 9 is then sufficient to break the seal and move the diverter 7 into the open position, thereby providing access for logging operations via the by-pass tubing connection 4.

Referring now to FIGS. 6 and 7 which show a variant of the above described completion tool, a pair of electrical submergible pumps ESP 20*a*, 20*b* are attached to the two depending limbs 3',5' of the tool 1' which tool 1' also has a surface tubing connection 2'. In this case, there are two pumps for redundancy which increases the reliability and life of the well and the life of the pumps. In this variant, a sealing insert 12' is provided in both depending limbs 3',5' of the tool 1' whilst the diverter 7' itself is provided with sealing surfaces 13*a*',13*b*' on opposing faces 14*a*',14*b*' thereof. As will be apparent from the subsequent description, a biasing torsion spring may be unnecessary in this variant.

Accordingly and as shown by the arrows in the sequence of FIGS. 6*a* to 6*c*, when a first ESP is operating the flow of fluid from that pump through the one limb 3' will cause the diverter 7' to seal the other limb 5' to which the non-operating or second ESP is connected.

Subsequently, when the first ESP is shut down, and as shown by the arrows in the sequence of FIGS. 7*a* to 7*c*, the second ESP is operated, this causes a pressure differential to build up across the opposing faces 14*a*,14*b* of the diverter 7' which occludes the limb 5' from which the second or operating ESP depends. However, continued operation of the pump causes the pressure differential to increase until it is sufficiently great to break the seal 13*b* and cause the diverter 7' to flip over and seal 13*a*' the one limb 3' of the tool 1' and prevent recirculation of fluids discharged from the second ESP into the well via the one limb 3'. With such a tool 1', it is possible to prevent recirculation through a non-operating ESP and simultaneously eliminate the need to pull and run blanking plugs into the respective limbs 3',5' of the tool 1' located above each ESP thereby saving both time and cost.

Finally, it will be appreciated by those skilled in the art that the tool is suitable not only for use in by-pass systems but has many other downhole applications. Furthermore, it will be realised that tool operation is not necessarily dependent on the existence of a pump generated pressure differential and could be operated simply by the fluid flow existing in a naturally producing well.

I claim:

1. A differential-pressure-operated blanking tool comprising:

a production tubing connection which communicates via an integral diverter with a pair of limbs which depend therefrom; said diverter, in the absence of fluid flow, remaining in an open position to allow access for logging operations via said limbs; said diverter being movable to a closed position occluding one of said limbs as a result of a pressure differential established between opposing faces of said diverter due to fluid flow in the tool and thereby preventing the fluid flow from recirculated via said limbs.

2. A tool as claimed in claim 1, wherein the diverter, in the absence of a pressure differential established between its faces, is held in the open position by biasing means.

3. A tool as claimed in claim 2, wherein the biasing means comprises a torsion spring.

4. A tool as claimed in claim 1, wherein the diverter is provided with sealing means on both its opposing faces such that it may occlude either one of said limbs.

5. A tool as claimed in claim 1, which further includes means for moving the diverter between from a closed position to an open position in the absence of fluid movement.

6. A tool as claimed in claim 5 wherein said diverter moving means is manually operable.

7. A tool as claimed in claim 1, wherein an artificial lift device depends from at least one of said limbs.

8. A tool as claimed in claim 7, wherein said artificial lift device comprises an electrical submergible pump.

* * * * *